US009136639B2

(12) United States Patent
Loureiro et al.

(10) Patent No.: US 9,136,639 B2
(45) Date of Patent: Sep. 15, 2015

(54) ELECTRICAL CONNECTOR RECEPTACLE FOR MOUNTING WITHIN AN EXPLOSION PROOF ENCLOSURE AND METHOD OF MOUNTING

(75) Inventors: Melissa Loureiro, Springfield, MA (US); Thomas E. Powell, Collinsville, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 324 days.

(21) Appl. No.: 13/486,657

(22) Filed: Jun. 1, 2012

(65) Prior Publication Data

US 2013/0323952 A1 Dec. 5, 2013

(51) Int. Cl.
*H01R 13/527* (2006.01)
*H01R 13/73* (2006.01)

(52) U.S. Cl.
CPC ..... *H01R 13/527* (2013.01); *H01R 13/73* (2013.01)

(58) Field of Classification Search
CPC ..... H01R 13/5202; H01R 13/5219; H01R 13/527
USPC ..... 439/578–581, 63, 83, 271–275
See application file for complete search history.

(56) References Cited

U.S. PATENT DOCUMENTS

| | | | | |
|---|---|---|---|---|
| 4,662,703 | A * | 5/1987 | Forney et al. | 439/578 |
| 4,684,200 | A * | 8/1987 | Capp | 439/63 |
| 4,964,805 | A * | 10/1990 | Gabany | 439/63 |
| 5,192,230 | A * | 3/1993 | Gabany et al. | 439/620.1 |
| 5,534,664 | A * | 7/1996 | Fearing et al. | 174/50 |
| 5,888,083 | A * | 3/1999 | Seilhan et al. | 439/161 |
| 6,024,609 | A * | 2/2000 | Kooiman et al. | 439/578 |
| 6,164,977 | A * | 12/2000 | Lester | 439/63 |
| 6,853,316 | B2 * | 2/2005 | Payson et al. | 439/271 |
| 7,520,779 | B2 * | 4/2009 | Arnaud et al. | 439/578 |
| 7,753,726 | B2 * | 7/2010 | Malstrom et al. | 439/581 |
| 7,802,993 | B2 * | 9/2010 | Akama et al. | 439/63 |
| 8,303,340 | B2 * | 11/2012 | Seiler | 439/589 |
| 2006/0068623 | A1 * | 3/2006 | Purdy | 439/133 |
| 2006/0258225 | A1 * | 11/2006 | Hsu | 439/638 |
| 2008/0261446 | A1 * | 10/2008 | Arnaud et al. | 439/578 |
| 2010/0323546 | A1 * | 12/2010 | Penumatcha et al. | 439/271 |
| 2011/0182551 | A1 * | 7/2011 | Aiudi et al. | 385/53 |

FOREIGN PATENT DOCUMENTS

| | | |
|---|---|---|
| CN | 1228632 A | 9/1999 |
| CN | 1275823 A | 12/2000 |

OTHER PUBLICATIONS

English translation of Office Action regarding related CN App. No. 201310217268.6; dated Feb. 28, 2015; 3 pages.

* cited by examiner

*Primary Examiner* — Briggitte R Hammond
(74) *Attorney, Agent, or Firm* — Cantor Colburn LLP

(57) ABSTRACT

An electrical connector receptacle for mounting within an explosion proof enclosure includes a flange portion having a first side, a second side and a centrally disposed aperture. Also included is a cylindrical member integrally formed with the flange portion and extending away from the first side. Further included is a plurality of apertures extending from the first side to the second side, wherein the plurality of apertures are configured to receive a mechanical fastener for mounting the electrical connector receptacle to a printed wiring board. Yet further included is an o-ring groove disposed within the first side and spaced radially outwardly from an outer surface of the cylindrical member. Also included is a plurality of mounting feet integrally formed with the flange portion and extending away from the second side to form an electrical bonding path to the printed wiring board.

12 Claims, 3 Drawing Sheets

ELECTRICAL CONNECTOR RECEPTACLE FOR MOUNTING WITHIN AN EXPLOSION PROOF ENCLOSURE AND METHOD OF MOUNTING

BACKGROUND OF THE INVENTION

The present invention relates to electrical connector receptacles, and more particularly to an electrical connector receptacle mounted within an explosion proof enclosure, as well as a method of mounting the electrical connector receptacle.

Electrical housings or enclosures provide protection for electrical controllers, circuit boards, and the like. Often, the enclosure and the electrical equipment are subjected to harsh operating environments. Environmental elements such as wind, rain, humidity, dirt, and the like may all cause damage to electrical components. In addition to exposure to environmental elements, electrical equipment is often mounted in areas that are exposed to various flammable liquids and/or gases that could be ignited if contacted by a spark or flame. When placed in environments that are exposed to flammable liquids and/or gases, electrical enclosures typically should be explosion proof by either containment, ventilation or through a hermetic seal. In other words, any flame that may be ignited within the enclosure should not be allowed to exit to external, surrounding areas. Connectors that penetrate into the enclosure also must be configured to comply with the explosion proof requirements.

BRIEF DESCRIPTION OF THE INVENTION

According to one embodiment, an electrical connector receptacle for mounting within an explosion proof enclosure includes a flange portion having a first side, a second side and a centrally disposed aperture extending therethrough from the first side to the second side. Also included is a cylindrical member integrally formed with the flange portion and extending away from the first side of the flange portion. Further included is a plurality of apertures extending through the flange portion from the first side to the second side, wherein the plurality of apertures are configured to receive a mechanical fastener for mounting the electrical connector receptacle to a printed wiring board. Yet further included is an o-ring groove disposed within the first side of the flange portion and spaced radially outwardly from an outer surface of the cylindrical member. Also included is a plurality of mounting feet integrally formed with the flange portion and extending away from the second side of the flange portion to form an electrical bonding path to the printed wiring board.

According to another embodiment, a method of mounting an electrical connector receptacle to a printed wiring board within an explosion proof enclosure is provided. The method includes inserting a cylindrical member of the electrical connector receptacle through a receiving hole of a chassis, wherein the cylindrical member is integrally formed with, and extends away from, a first side of a flange portion. Also included is engaging a plurality of mounting feet with a printed wiring board, wherein the plurality of mounting feet are integrally formed with, and extend away from, a second side of the flange portion. Further included is disposing the first side of the flange portion along an inner surface of the chassis. Yet further included is fastening the first side of the flange portion to the inner surface of the chassis with at least one mechanical fastener, wherein the at least one mechanical fastener extends through the chassis into at least one aperture extending through the flange portion.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
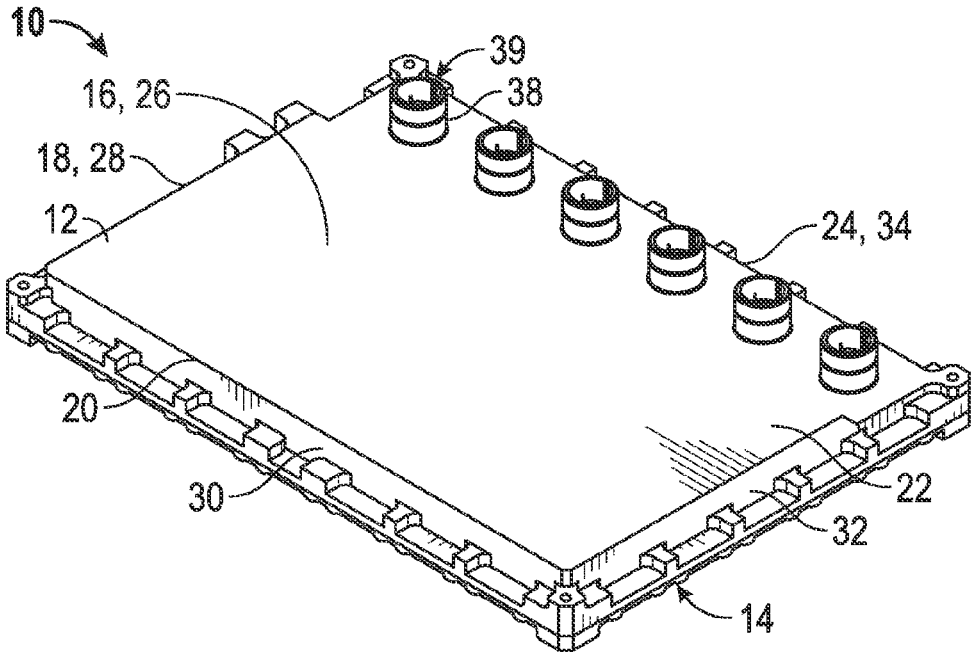
FIG. 1 is a top perspective view of an explosion proof enclosure having a plurality of electrical connector receptacles mounted therein.
Figure 2:
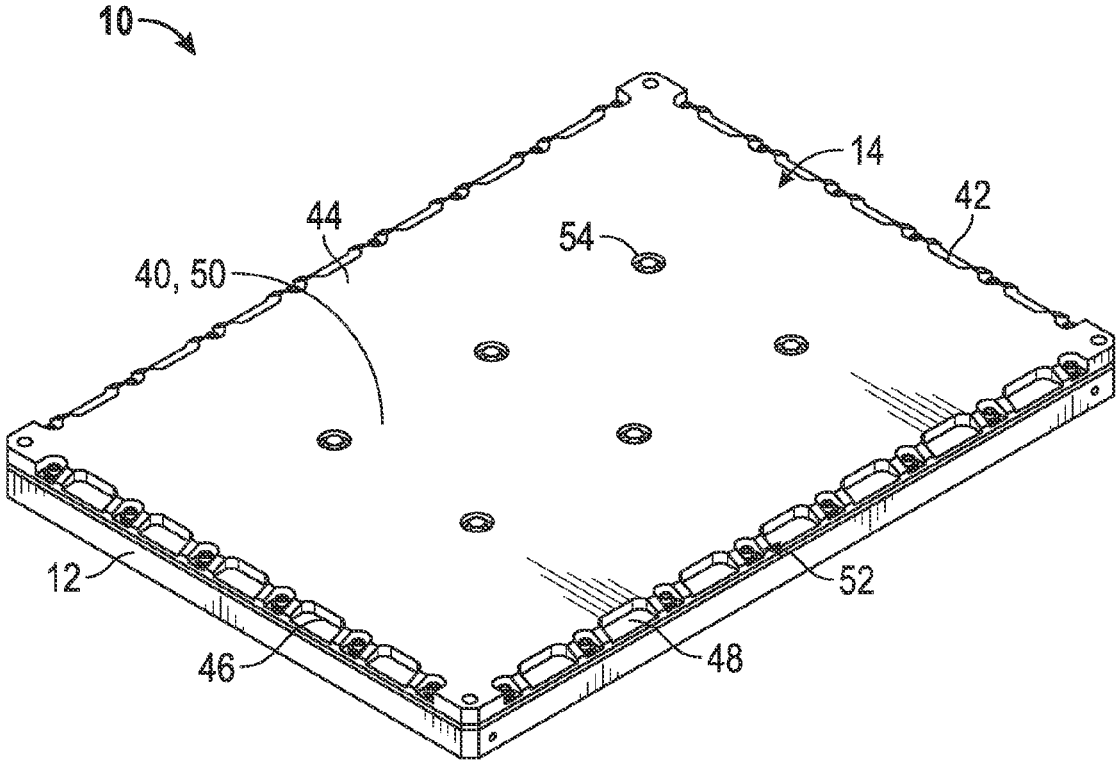
FIG. 2 is a bottom perspective view of the explosion proof enclosure shown in FIG. 1.

Referring to FIGS. 1 and 2, an explosion proof enclosure is generally referred to with numeral 10. The explosion proof enclosure 10 includes a chassis 12 and a cover 14. The chassis 12 includes a base wall 16 having a first edge 18 and a second edge 20 that join with a third edge 22 and a fourth edge 24 to define a substantially planar surface 26. The explosion proof enclosure 10 also includes a first side wall 28, a second side wall 30, a third side wall 32 and a fourth side wall 34 that extend generally perpendicularly from the first edge 18, the second edge 20, the third edge 22 and the fourth edge 24, respectively. An interior zone is defined by the base wall 16, the first side wall 28, the second side wall 30, the third side wall 32 and the fourth side wall 34. The interior zone is configured to house various electronic components such as a printed wiring board (PWB), one or more controllers, computers and the like. The chassis 12 also includes at least one, but typically a plurality of receiving holes 38 within the base wall 16 for receiving an electrical connector receptacle 39 to engage the PWB, for example. As shown, a plurality of connector receptacles 39 will often be present.

The cover 14 of the explosion proof enclosure 10 includes a cover body 40 having a first edge 42 and a second edge 44 that join with a third edge 46 and a fourth edge 48 to form a generally planar surface 50. The cover 14 includes a first plurality of fastener openings 52 and a second plurality of fastener openings 54. The first plurality of fastener openings 52 extend along the first edge 42, the second edge 44, the third edge 46 and the fourth edge 48. Mechanical fasteners are employed to operably couple the cover 14 to the chassis 12 through the first plurality of fastener openings 52. The second plurality of fastener openings 54 are arranged generally centrally on the generally planar surface 50 and configured to provide additional securement of the cover 14 to the chassis 12 proximate a central region. The additional securement proximate the central region reduces bowing and/or flexing of the cover 14 which may result from internal pressure within the interior zone, such as from an internal flame, for example. The cover 14 and chassis 12 combine to reduce the likelihood of any egress of flames that may be present within the interior zone. It shall be understood that the orientation of the cover 14 and chassis 12 could be reversed. In such a case, the chassis 12 will "cover" the cover 14.

Figure 3:
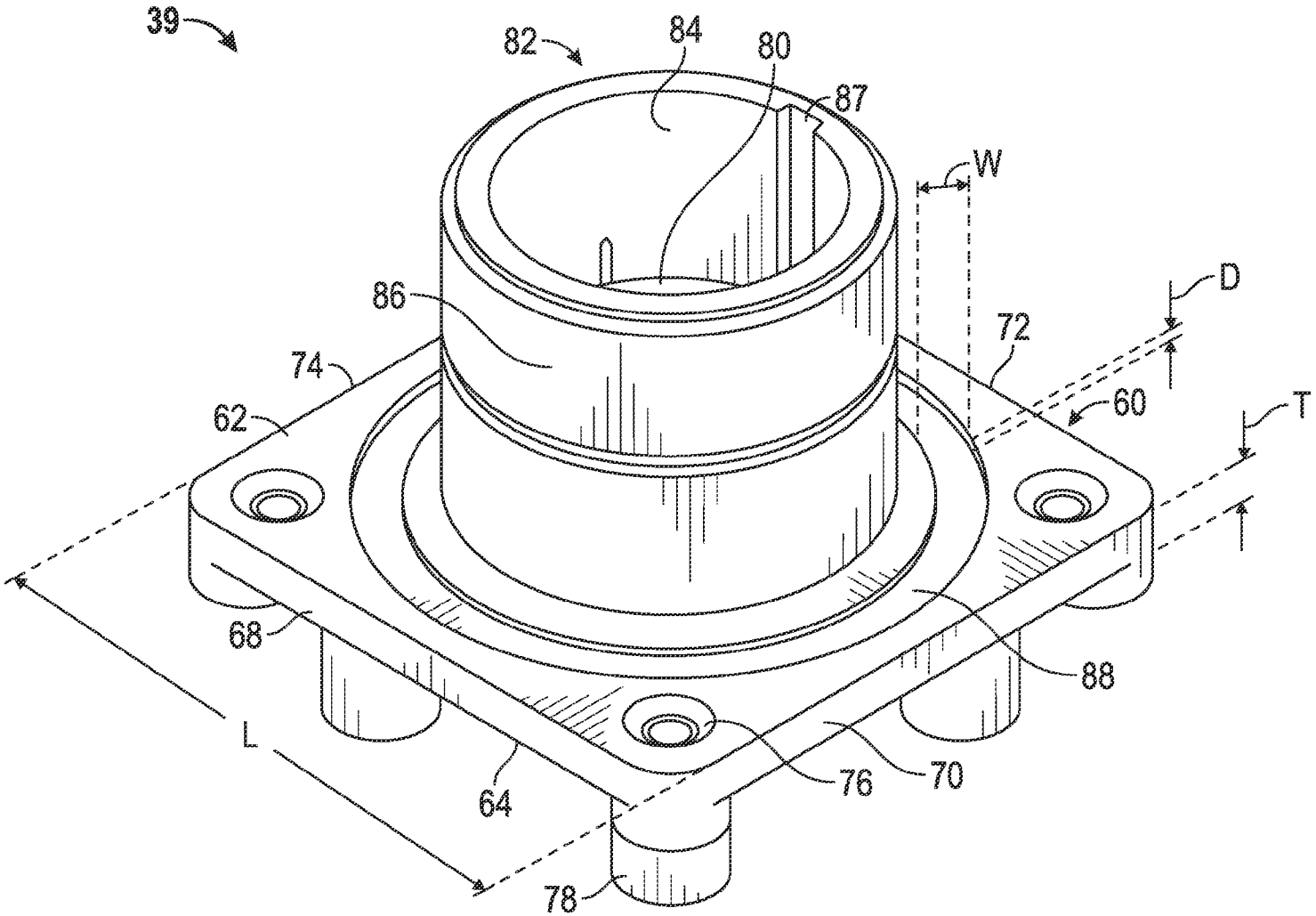
FIG. 3 is a perspective view of one of the plurality of electrical connector receptacles.

Referring now to FIG. 3, the electrical connector receptacle 39 is illustrated in greater detail. The electrical connector receptacle 39 includes a flange portion 60 having a first side 62 (i.e., a top surface) and directly opposite second side 64 (i.e., a bottom surface). Extending between the first side 62 and the second side 64 is a first side portion 68, a second side portion 70 extending relatively perpendicularly from the first side portion 68, a third side portion 72 extending relatively perpendicularly from the second side portion 70 and a fourth side portion 74 extending relatively perpendicularly from the third side portion 72 to the first side portion 68. The flange portion 60 is illustrated as having a relatively square shape, however, it is to be appreciated that the flange portion 60 may be of various other geometries, including rectangular, for example. In the exemplary embodiment of a square geometry, where the first side portion 68, the second side portion 70, the third side portion 72 and the fourth side portion 74 are of relatively equal lengths, an illustrative length L ranges from about 1.600 inches (about 40.640 mm) to about 2.500 inches (about 63.500 mm). An exemplary thickness T of the flange portion 60 ranges from about 0.125 inches (about 3.175 mm) to about 0.375 inches (about 9.525 mm).

Extending through the flange portion 60 from the first side 62 to the second side 64 at an outer region of the flange portion 60 are a plurality of apertures 76 configured to receive mechanical fasteners (not illustrated) for mounting the electrical connector receptacle 39, and more particularly the first side 62 of the flange portion 60 to the chassis 12, and more particularly an inner surface of the chassis 12. Furthermore, the mechanical fasteners may extend through the plurality of apertures 76 and into the PWB for direct mounting of the electrical connector receptacle 39, and more particularly the second side 64 of the flange portion 60. Direct mounting of the electrical connector receptacle 39 is further facilitated by a plurality of mounting holes 78 extending away from the second side 64 of the flange portion 60, which operably engage at least a portion of the PWB. The direct mounting of the electrical connector receptacle 39 via the mechanical fasteners through the plurality of apertures 76, as well as the plurality of mounting holes 78, provides a bonding path between the electrical connector receptacle 39 and the PWB. The mounting holes 78 may be formed in a non-symmetrical manner to provide polarization, as well as to ensure proper installation orientation during assembly. The electrical connector receptacle 39 is fixed to the PWB prior to securement of the PWB to the chassis 12.

A centrally disposed aperture 80 is located within the flange portion 60 of the electrical connector receptacle 39 and extends through the flange portion 60 from the first side 62 to the second side 64. Extending away from the centrally disposed aperture 80, as well as the first side 64 of the flange portion 60, is a cylindrical member 82 having an inner surface 84 and an outer surface 86. The cylindrical member is configured to receive and retain a connector (not illustrated) to be engaged with the PWB. At least a portion of the outer surface 86 of the cylindrical member 82 may be threaded to securely mate with a connector having a corresponding thread configuration. To assist in positioning a connector within the electrical connector receptacle 39, a keyway 87 extending along the inner surface 84 of the cylindrical member 82 may be provided.

Disposed within the first side 62 of the flange portion 60 and radially outwardly of the outer surface 86 of the cylindrical member 82 is an o-ring groove 88. The o-ring groove 88 is configured to engage and/or fittingly receive an o-ring disposed on the inner surface of the chassis 12 when the electrical connector receptacle 39 is in a mounted position with the chassis 12. In an exemplary embodiment, the o-ring groove 88 includes a width W ranging from about 0.105 inches (about 2.667 mm) to about 0.130 inches (about 3.302 mm) and a depth D of protrusion into the first side 62 of the flange portion 60 ranging from about 0.056 inches (about 1.422 mm) to about 0.077 inches (about 1.956 mm).

Figure 4:
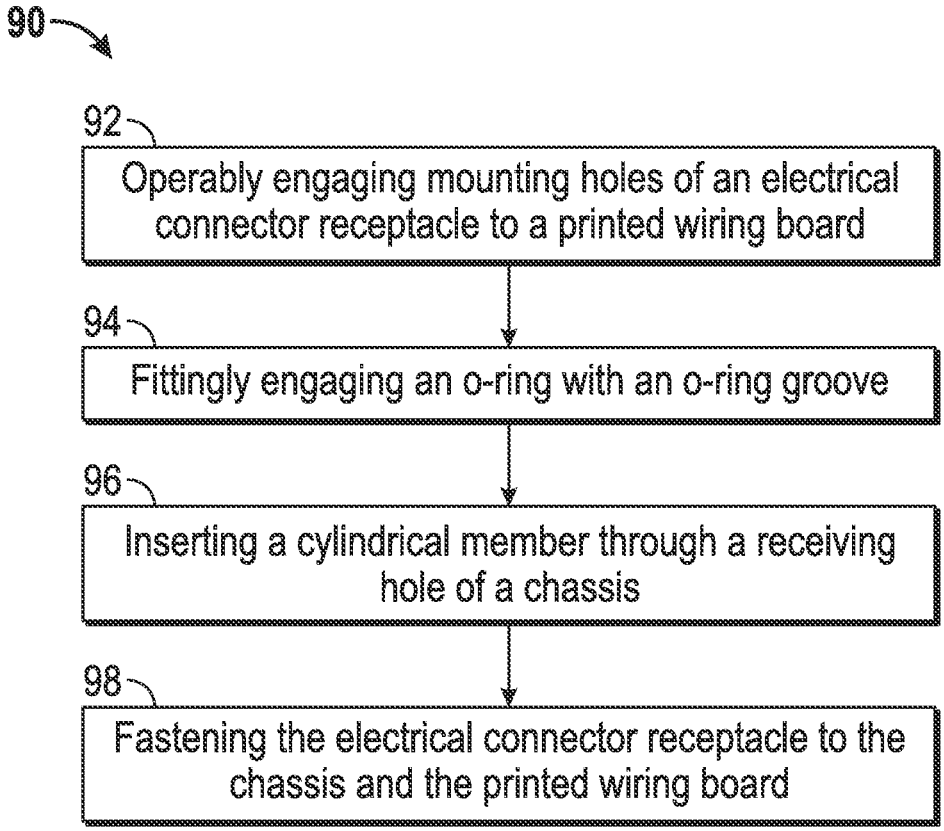
FIG. 4 is flow diagram illustrating a method according to one embodiment.

A method of mounting 90 the electrical connector receptacle 39 to the explosion proof enclosure 10 is also provided as illustrated in FIG. 4 and with reference to FIGS. 1-4. The explosion proof enclosure 10 and the electrical connector receptacle 39 have been previously described and specific structural components need not be described in further detail. The method of mounting 90 includes operably engaging the mounting holes 92 with the PWB and fittingly engaging the o-ring 94 with the o-ring groove 88. The method also includes inserting a cylindrical member through a receiving hole 96 of the chassis 12. Additionally, the electrical connector receptacle 39 is fastened 98 to the chassis 12 and the PWB with a plurality of mechanical fasteners extending through the chassis 12, the plurality of apertures 76 and into the PWB.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An explosion proof enclosure comprising:

an electrical connector comprising:

a flange portion having a first side, a second side and a centrally disposed aperture extending therethrough from the first side to the second side;

a cylindrical member integrally formed with the flange portion and extending away from the first side of the flange portion;

a plurality of apertures extending through the flange portion from the first side to the second side, wherein the plurality of apertures are configured to receive a mechanical fastener for mounting the electrical connector receptacle to a printed wiring board;

an o-ring groove disposed within the first side of the flange portion and spaced radially outwardly from an outer surface of the cylindrical member, the o-ring groove forming a recessed region relative to the first side of the flange portion; and a plurality of mounting feet integrally formed with the flange portion and extending away from the second side of the flange portion to form an electrical bonding path to the printed wiring board.

2. The explosion proof enclosure of claim 1, wherein the explosion proof enclosure comprises a chassis and a cover operably coupled to the chassis, wherein the chassis and cover form an interior compartment for housing the printed wiring board.

3. The explosion proof enclosure of claim 2, wherein the first side of the flange portion engages an inner surface of the chassis and is mechanically fastened thereto.

4. The explosion proof enclosure of claim 2, wherein the o-ring groove is configured to fittingly engage an o-ring disposed on an inner surface of the chassis.

5. The explosion proof enclosure of claim 1, wherein the o-ring groove comprises a width of about 0.130 inches (about 3.302 mm).

6. The explosion proof enclosure of claim 1, wherein the o-ring groove protrudes into the first side of the flange portion to a depth of about 0.077 inches (about 1.956 mm).

7. The explosion proof enclosure of claim 1, wherein the flange portion comprises a thickness of about 0.25 inches (about 6.35 mm).

8. The explosion proof enclosure of claim 1, wherein the flange portion comprises a first edge and a second edge, wherein a first edge length is relatively equal to a second edge length.

9. The explosion proof enclosure of claim 8, wherein the first edge length and the second edge length ranges from about 1.875 inches (about 47.625 mm) to about 2.200 inches (55.880 mm).

10. The explosion proof enclosure of claim 2, wherein the cylindrical member is disposed within a receiving hole of the chassis.

11. The explosion proof enclosure of claim 1, wherein the plurality of apertures are each disposed at an outer region of the flange portion.

12. The explosion proof enclosure of claim 1, further comprising a keyway formed in an inner surface of the cylindrical member.

* * * * *